US005197521A

United States Patent [19]

Graser et al.

[11] Patent Number: 5,197,521

[45] Date of Patent: Mar. 30, 1993

[54] WARP BEAM LIFTING CARRIAGE FOR LOOM INSERTION

[75] Inventors: Helmut Graser, Riederich; Armin Hiemer, Lindau, both of Fed. Rep. of Germany

[73] Assignee: Lindauer Dornier Gesellschaft mbH, Lindau, Fed. Rep. of Germany

[21] Appl. No.: 840,864

[22] Filed: Feb. 24, 1992

[30] Foreign Application Priority Data

Feb. 25, 1991 [DE] Fed. Rep. of Germany ..... 4105824

[51] Int. Cl.[5] ..... D03D 49/20

[52] U.S. Cl. ..... 139/1 R; 28/201

[58] Field of Search ..... 139/1 R, 291 R; 28/201; 414/911

[56] References Cited

U.S. PATENT DOCUMENTS 5,022,439 6/1991 Yano et al. ..... 139/1 R 5,031,666 7/1991 Raaijmakers et al. ..... 139/1 R

FOREIGN PATENT DOCUMENTS 686771 3/1965 Italy ..... 28/201

*Primary Examiner*—Andrew M. Falik

*Attorney, Agent, or Firm*—W. G. Fasse

[57] ABSTRACT

A warp beam lifting carriage for removing an empty warp beam from a loom or for inserting a full warp beam into a loom, is equipped with positioning devices that permit a precise positioning of the carriage in the three directions of space. An insertion stop mechanism limits the movement of the carriage toward the loom. A lateral restraining device makes sure that the carriage is horizontally centered relative to the loom in a direction perpendicularly to the movement direction toward the loom. A third leveling device makes sure that the longitudinal axis of the warp beam shaft can be precisely aligned with the horizontal axis of floating axle stubs that are inserted through bearings into sockets at the free ends of the wrap beam shaft. The precise alignment is quickly achieved and increases the productivity of the loom.

14 Claims, 4 Drawing Sheets 1
2
2a
2b
3
3a
3b
4
4'
5
5'
6
6a
6b
7
7'
8
8'
9
9'
9a
9b
9c
9d
10
10'
11
11'
12
13
14
14a
15
15'
17
17'
18
18A
18B
18'
19
19'
20
20'
21
21'
22
22a
22b
23
24
25
31
31a
31b
A

WARP BEAM LIFTING CARRIAGE FOR LOOM INSERTION

FIELD OF THE INVENTION

The invention relates to a lifting carriage for exchanging a warp beam in a loom. The warp beam has floating axle stubs for insertion into respective floating bearings in the loom.

BACKGROUND INFORMATION

Lifting carriages of this type are equipped with a tiltably mounted carrier transom having adjustable transom sections adaptable to the lengths of different warp beams. Each adjustable transom section is equipped with a carrier arm which in turn holds at its free end a gripper for the shaft of a warp beam, which may be a hollow shaft.

The carrier transom in conventional warp beam lifting carriages is hydraulically operated and the carrier arms are in turn equipped with a fine level adjustment mechanism in order to assure the exchange of an empty warp beam by a full warp beam without any troubles. For this purpose, it is necessary that the floating axle stubs extending axially out of the warp beam shaft are axially precisely aligned with the respective floating bearings in the loom. More specifically, it is especially necessary to precisely align the carrier arm axis of the lifting carriage with the axis of the warp beam shaft prior to the insertion of the floating axle stubs. The alignment of the carrier arms of the lifting carriage, more specifically, the alignment of the warp beam axis with the axis of the floating bearings for the stubs in the loom must be precise in the vertical direction relative to the elevation of the bearing axis and horizontally relative to the insertion depth of the carriage into the loom so that the warp beam axis coincides or rather is axially aligned with the axis of the two floating bearings. Only when this alignment is precisely assured, is it possible to insert the floating axle stubs supported in the floating axle bearings in the loom, into the respective sockets at the ends of the warp beam shaft.

Since a full warp beam has a substantial weight, the carriage holding such a full beam is also heavy, and a precision adjustment of the carriage by manual means, is difficult and accordingly time consuming.

Further, after the warp beam has been inserted into the loom, it is necessary to also align the beam laterally relative to the loom in order to assure a parallel and rectangular thread withdrawal from the warp beam and a respective warp thread supply to the heald shafts. This additional lateral adjustment is also time consuming and hence adversely affects the productivity of the loom.

Even for removing an empty warp beam out of the loom, the carrier arms of the lifting carriage must also be exactly aligned with regard to elevation and insertion depth relative to the warp beam shaft. If the alignment is less than precise, it becomes impossible to withdraw the floating axle stubs which become jammed in the bearings due to the friction between the floating axle stubs and the respective bearings. As a result, any deviations from a full alignment of the axle stubs with the central longitudinal rotational axis of the warp beam, must be kept within a permissible very small deviation range.

OBJECTS OF THE INVENTION

In view of the foregoing it is the aim of the invention to achieve the following objects singly or in combination:

- to construct a warp beam lifting carriage in such a way that a three-dimensional positioning in the three directions of a three-dimensional coordinate system, of the warp beam lifting carriage relative to a loom, eliminates or substantially reduces the need for a manual fine adjustment;
- to make sure that the insertion and removal of the floating axle stubs can be accomplished with ease and efficiency for an exchange of an empty warp beam by a loaded warp beam;
- to achieve a power controlled axial alignment between the floating axle stubs and the central longitudinal axis of the warp beam for avoiding the conventionally required manual adjustment or alignment; and
- to increase the useful life of the floating axle stubs and the respective bearings in the loom by reducing friction between the axle stubs and the stub bearings.

SUMMARY OF THE INVENTION

A warp beam lifting carriage according to the invention is characterized by the combination of the following features. An insertion stop mechanism limits the depth of insertion of the warp beam lifting carriage horizontally into the loom. The insertion stop mechanism extends in parallel to the carrier arms of the carriage which arms are equipped with grippers for carrying a warp beam. A leveling device cooperates with the respective insertion stop mechanism. The leveling device vertically adjusts the warp beam grippers to the warp beam shaft. The leveling device is preferably connected to the insertion stop mechanism. The warp beam lifting carriage and the loom are equipped with lateral restraining members facing each other for fixing the position of the lifting carriage in the horizontal direction in the loom.

In a further embodiment of the invention, each insertion stop mechanism cooperates with the respective leveling device for the corresponding carrier arm add gripper and with the corresponding floating bearing for the respective floating axle stub.

The insertion stop mechanism is constructed as a bracket that is rigidly connected to the respective adjustable transom section in such a way that the free end of the bracket contacts centrally the respective floating axle bearing housing of the loom. The free end of the bracket is suitably equipped with a stop element that is adjustable in its elevational position and which has a somewhat bulging or crowned surface for contacting the respective bearing housing in the loom.

The leveling device used according to the invention makes sure that an unimpeded connection of the warp beam with the loom by means of the floating axle stubs extending through floating axle bearings of the loom, into the respective sockets of the warp beam shaft, is accomplished. These leveling devices completely compensate any possible level or elevational differences between the sockets that receive the floating axle stubs in the warp beam shaft and the floating axle bearings of the loom. These leveling devices comprise a tilting lever that is journalled about an axis which is preferably secured to the insertion stop mechanism. The tilting lever has a free arm which reaches at least partly around the respective floating axle stub bearing of the loom and carries a roller that determines the leveling.

Further, the tilting lever of the leveling device is connected to a drive member that is preferably secured to the insertion stop mechanism. The drive member for the tilting lever may, for example, comprise a piston cylinder device, a linear motor, or a drive spindle that may be manually operated without lifting the entire carriage.

In order to properly perform the leveling, the adjustable transom sections are tiltable, preferably together with their carrier transom, about a horizontal axis at least to such an angular extent that their tilting corresponds to a level difference that must be eliminated. Such level difference between the bearings in the loom and the sockets in the warp beam shaft, may be rather small, for example a few millimeters. Thus, the equivalent or corresponding angular movement is also very small.

The adjustable transom sections are tiltable together with their carrier transom which is journalled in two arms of a carrier cross beam of the carriage. However, it is also possible to keep the carrier transom stationary and tilt the adjustable transom sections relative to their carrier transom.

An efficient leveling is accomplished if the leveling roller of the tilting lever reaches beyond the geometric longitudinal axis of the respective floating axle stub bearing as viewed in the travel direction of the lifting carriage toward the loom.

In addition to the elevational alignment just described, it is also necessary to provide a lateral limitation or guide for the movement of the carriage into the loom. For this purpose, the loom carries in the area of at least one of the floating axle stub bearings, a fixed lateral limiting member which cooperates with respective members on the carriage. This lateral limiting member fixes in cooperation with the limiting members on the carriage, the position of the carriage immediately prior to the point when the carriage assumes its operational position in the loom. These lateral position limiting members on the carriage preferably comprise two limiting rollers having parallel axes and spaced from each other to roll onto the limiting member carried by the loom.

The most important advantage of the warp beam lifting carriage according to the invention is seen in that the conventionally necessary manual adjustment or alignment of the carriage is entirely avoided, so that an empty warp beam can be efficiently removed from the loom, and a loaded warp beam can efficiently be inserted into the loom. As a result, the quickly achieved precise alignment reduces wear and tear on the floating axle stubs and on the floating axle stub bearings so that the useful life of these components, especially the bearings, is substantially prolonged. Equally advantageous is the substantial reduction in the time that has been necessary heretofore for the exchange of an empty warp beam by a loaded warp beam, whereby the productivity of the loom is substantially increased.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
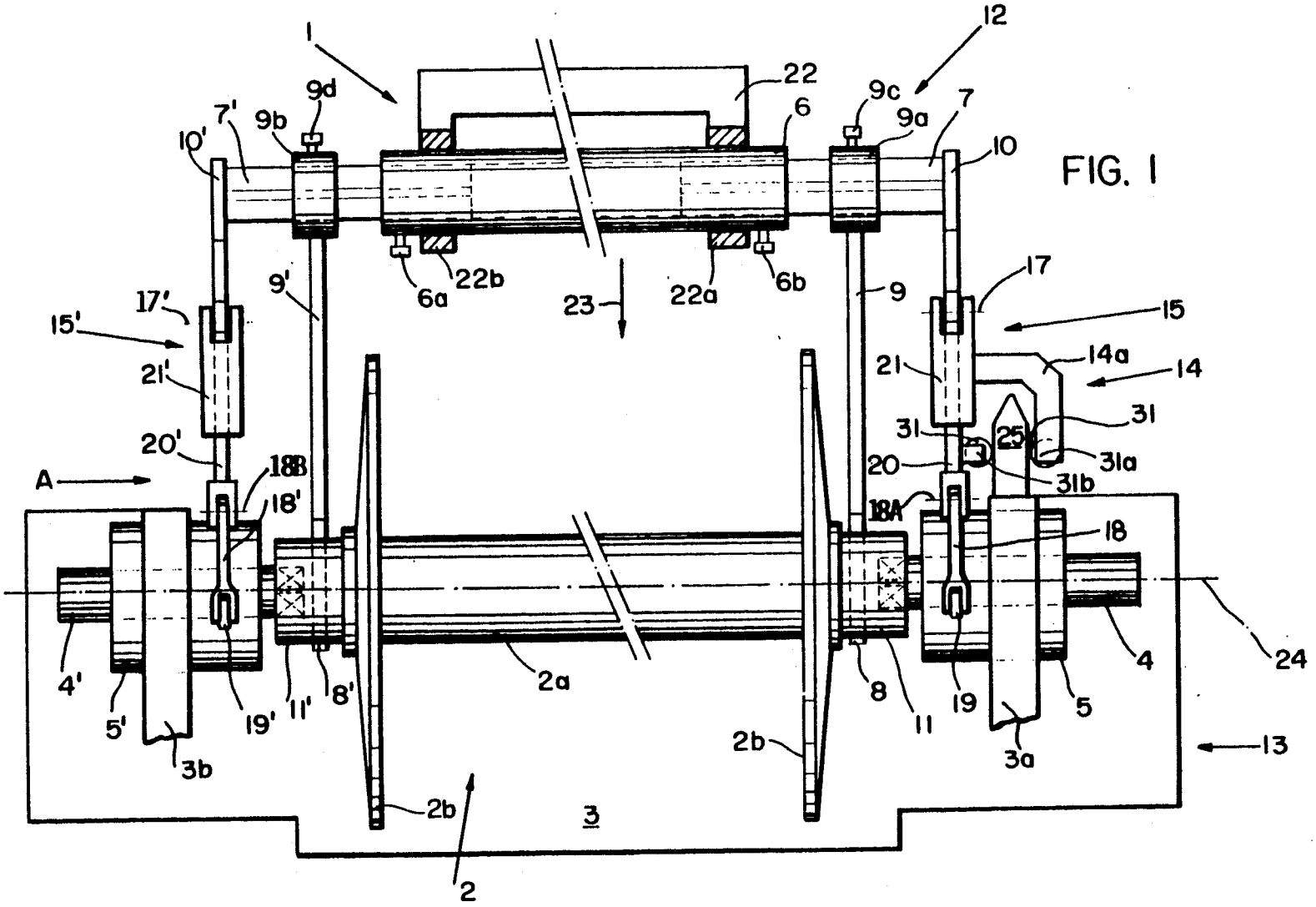
FIG. 1 is a top plan view of a warp beam lifting carriage in its position in the loom under the control of the leveling device and the lateral restraining members, whereby the carriage is ready to remove an empty warp beam.
Figure 2:
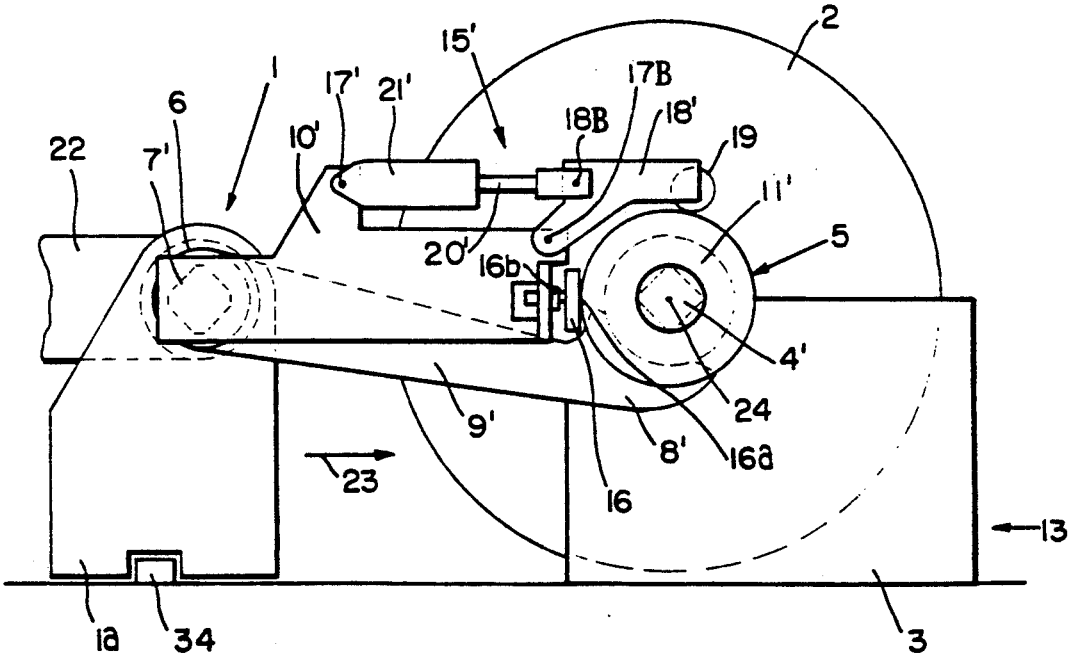
FIG. 2 is a view in the direction of the arrow A in FIG. 1, illustrating the pick up position of a warp beam with the leveling device in a closed position.
Figure 3:
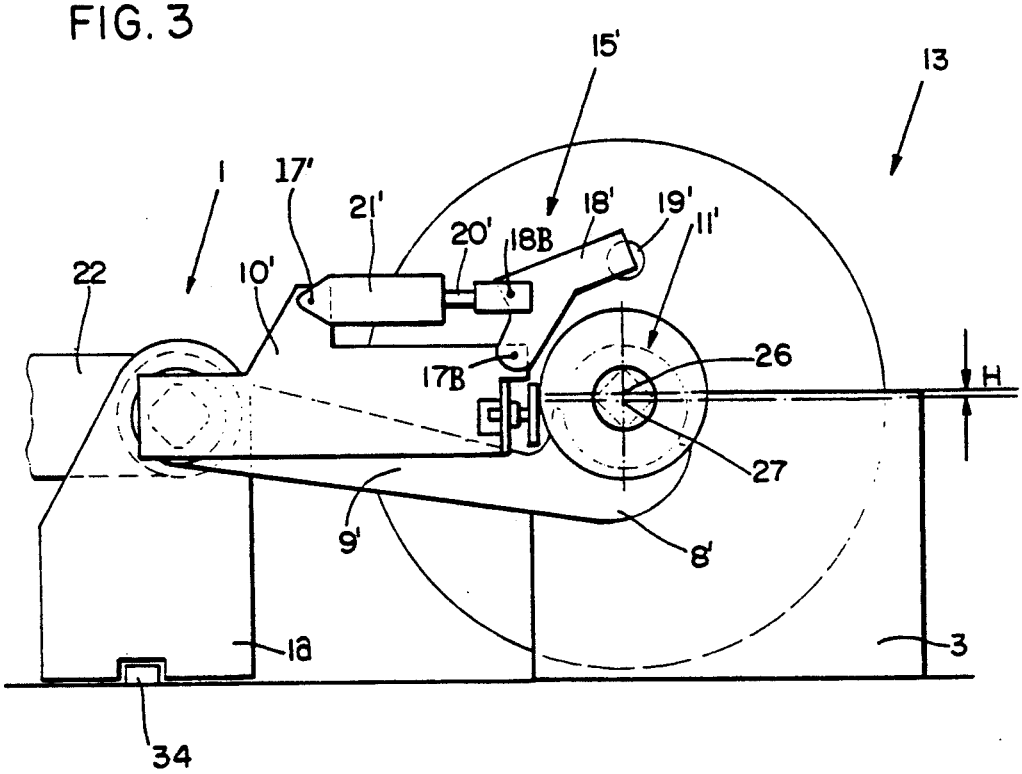
FIG. 3 is a view similar to that of FIG. 2, but showing the leveling device in an opened position.

FIGS. 1, 2, and 3 show a loom 13 having a frame 3 and a warp beam lifting carriage 1 having a carriage frame 1*a*. Each of these Figs. also shows a warp beam 2 having a warp beam shaft 2*a* with two lateral flanges 2*b*. The shaft 2*a* extends through the flanges 2*b* and forms at each of its free ends a socket 11, 11' with a square hole for receiving floating axle stubs 4, 4' insertable into these square holes with a sliding fit. FIG. 1 further shows two upright posts 3*a* and 3*b* rigidly secured to the frame 3 of the loom 13 and carrying respective floating bearings 5, 5' for the axle stubs 4, 4' respectively. These floating bearings 5, 5' are mounted in the upright posts 3*a*, 3*b*, respectively.

The warp beam lifting carriage 1 comprises in addition to the mentioned frame 1*a*, a carrier cross beam 22 having two arms 22*a* and 22*b* supporting, preferably in a tiltable manner, a horizontally extending carrier transom 6. Horizontally adjustable carrier transom sections 7 and 7' are operatively mounted to the carrier transom 6. Preferably, the carrier transom 6 is a hollow beam or pipe in which the adjustable transom section 7 is received in the right-hand end and the adjustable transom section 7' is received in the left-hand end of the carrier transom 6. These adjustable transom sections 7, 7' have a sliding fit inside the carrier transom 6 and are arrested against further axial movement in an adjusted position by screws 6*a* and 6*b*.

An insertion stop mechanism, including a rigid bracket 10, 10', is secured to each free end of the respective transom section 7, 7'. These stop brackets 10, 10' limit the horizontal insertion depth of the carriage 1 into the loom 13 as will be described in more detail below. Each stop bracket carries at its free end facing toward the loom a stop member 16 that has a radially outwardly bulging or crowned surface 16*a*. The bracket facing side of the vertically adjustable stop member 16 is secured to the bracket by vertical adjustment means 16*b* as shown in FIGS. 2 and 4.

Referring again to FIG. 1, each transom section 7, 7' carries or supports a beam carrier arm 9, 9' which is preferably slideably secured to the respective transom section 7,7' by a corresponding bushing 9*a* and 9*b* received with a sliding fit on the corresponding transom section for an axial adjustment back and forth along the respective transom section. Screws 9*c* and 9*d* permit fixing the arms 9, 9' in an adjusted position that depends on the length of the respective warp beam shaft 2*a*. Each carrier arm 9, 9' carries at its free end a shaft gripper 8, 8' for gripping around the socket ends 11, 11' of the shaft 2*a*. Due to the just described axial adjustment of the position of the arms 9, 9' along the transom sections 7, 7' in combination with the axial adjustment of these transom sections relative to the carrier transom 6, a fine adjustment within a wide range of beam shaft lengths is possible.

FIG. 1 further shows on its right-hand side a device 14 for laterally restraining the lifting carriage horizontally in a direction of the longitudinal axis 24 of the warp beam. This restraining device 14 comprises a rigid pin 25 rigidly secured to the frame 3 of the loom 13, for example, to the upright post 3a. The pin 25 has a guide tip 25a for cooperation with lateral guide rollers 31 rotatably secured to a lateral restraining arm 14a forming part of the restraining device 14 and to the respective stop bracket 10 to form a gap into which the pin 25 can enter when the carriage 1 moves toward the loom 13. When the rollers 31 engage the tip 25a, the carriage 1 is properly guided in the direction 23 horizontally toward the loom 13 and centered relative to the floating bearings or bearing housings 5, 5'. The point tip 25a merges into two parallel surfaces of the pin 25. The two rollers 31 have parallel axes 31a and 31b. Thus, there are two limits imposed horizontally. The stop brackets 10, 10' with their stop members 16 limit the movement of the carriage 1 in the direction of the arrow 23 toward the loom in one horizontal direction while the two rollers 31 in cooperation with the guide pin 25 limit or restrain the carriage position in a horizontal direction perpendicularly to the direction 23, namely in the direction of the longitudinal axis 24 of the warp beam shaft 2a.

Figure 4:
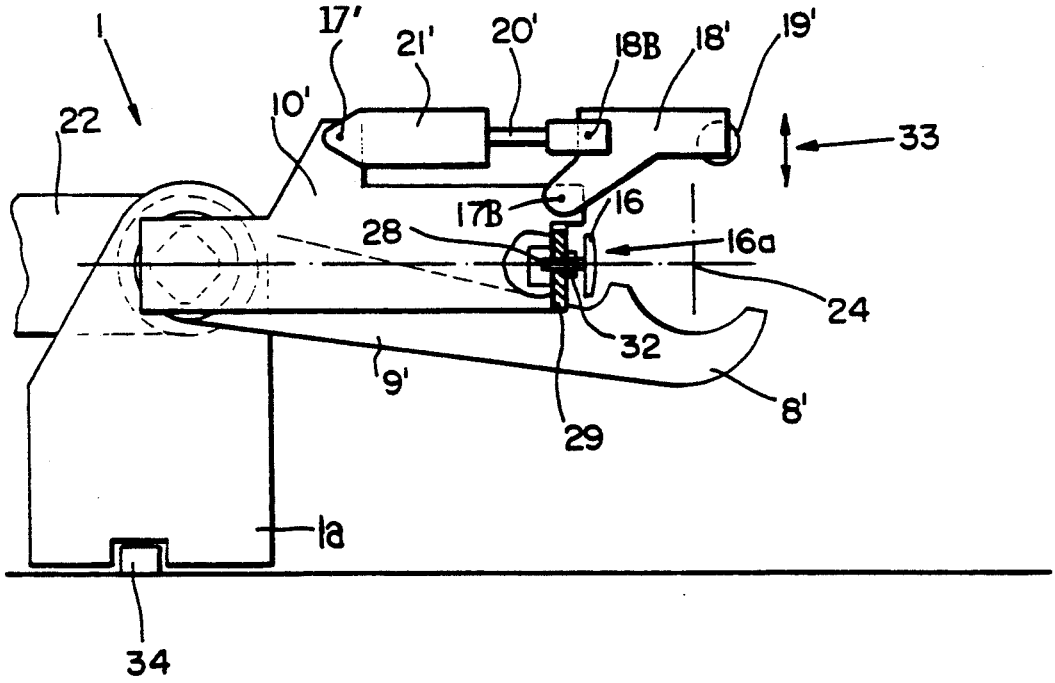
FIG. 4 shows the leveling device in the same closed position as in FIG. 2, however, without a warp beam.

FIGS. 2, 3, and 4 show the vertical leveling devices 15, 15' for vertically adjusting the carrier arms 9, 9' into a precise alignment with the horizontal axis 24 as will be described in more detail below.

The horizontal axis 24 is also the central axis of the floating bearings 5, 5'. The leveling devices 15, 15' are journalled at 17, 17' and 17A, 17B to the respective stop bracket 10, 10' as best seen in FIGS. 2, 3, and 4. Each leveling device 15, 15' comprises a respective piston cylinder device 21, 21' journalled at 17, 17' with one end of its cylinder to a projection of the respective stop bracket 10, 10' and with the respective piston rod 20 at 18A and 18B, 20' to a tilting lever 18, 18' which carries a leveling roller 19, 19' also seen in FIG. 1. Each tilting lever 18, 18' is tiltable about a respective journal axis 17A, 17B at which the tilting lever is journalled to the respective bracket 10, 10'. The free end of each piston rod 20, 20' is journalled to the respective tilting lever 18, 18' at 18A, 18B as best seen in FIGS. 2 and 4. Each tilting lever 18, 18' carries at its free end a respective leveling roller 19, 19' which in cooperation with its tilting lever, and with the gripper end 8, 8' of the respective carrier arm 9, 9', forms a gripping device. Preferably, the horizontal length of the tilting lever 18, 18' is such that the leveling roller 19 reaches horizontally beyond the axis 24 as viewed in the direction 23 which is the direction of the carriage movement into the loom. In this position of the leveling roller 19, 19' the latter is positioned to the right of the axis 24 as best seen in FIG. 4, and the crowned surface 16a of the stop member 16 rests against the respective bearing 5, 5'. This off-center position of the leveling rollers 19, 19' has the advantage that the thereby exerted force onto the housing of the respective bearing 5, 5' makes sure that the carriage 1 and thus the insertion stop elements, particularly the stop member 16, is maintained in contact with the respective bearing housing. Stated differently, this force pulls the insertion stop member 16 against the bearing housing to facilitate the alignment.

FIG. 3 shows that the lifting arms 9, 9' with their grippers 8, 8' have lifted the warp beam shaft 2a with its socket ends 11, 11' into the position between the two bearings 5, 5' into such a level that there is a level difference H between the centers 26 of the sockets at the end of the shaft 2a and the centers 27 of the axle stubs 4, 4' mounted in the bearings 5, 5'. This level difference H is normally very small and may even be zero. If it is zero, no further adjustment is necessary, and the axle stubs may be directly inserted into the respective sockets. However, said a precise adjustment immediately upon movement of the carriage into the loom is an exception. According to the invention, the level difference H is brought to zero by the leveling device 15, 15'.

Referring to FIG. 2, when the roller 19, 19' bears against the respective bearing 5, 5' it constitutes a support point for slightly lifting or lowering the arms 9, 9' by extending or retracting the piston rod 20, 20'. This adjustment movement of the arms 9, 9' is possible because the brackets 10, 10' are rigidly connected to the arms 9, 9' through the transom sections 7, 7' and because the journals 17, 17', 17A, 17B and 18A, 18B permit a slight turning of the brackets 10, 10' about the axis of the transom sections 7, 7' whereby the arms 9, 9' are correspondingly turned for eliminating the level difference H. Once the just described adjustment is made by operating the piston cylinder device 21, 21', the axle stubs 4, 4' may be easily inserted into the respective sockets 11, 11' through the respective bearings 5, 5' without any trouble.

FIG. 4 shows the stop member 16 in somewhat more detail. The stop member 16 is secured by a bolt 28 in a threaded hole of a cover plate 29 and held in place by a counternut 32. The cover plate 29 is movable up and down within certain limits and an adjustment member not shown fixes the plate 29 to the bracket 10, 10' in a vertically adjusted position. The front face 16a, that contacts the respective housing of the bearing 5, 5' has a crowned or beaded surface, as mentioned above. This feature provides a point contact with the respective bearing housing, whereby the construction is such that the surface 16a can adapt itself to any leveling of the arms 9, 9' to accommodate displacements in the vertical direction between these arms 9, 9' and the respective housing of the bearings 5, 5' with as little friction as possible.

FIG. 4 shows with the arrow 33 the up and down movement of the roller 19, 19', depending on the operation of the piston cylinder device 21, 21'. When the piston rod 20, 20' moves to the left, the roller 19, 19' moves up. When the piston rod moves to the right the respective roller moves down. Actually, the roller moves along a circle around the journal axis 17, 17' which is acceptable for the present purposes.

The present warp beam lifting carriage 1 operates as follows. Assuming there is no warp beam in the loom, carriage 1 carrying a full warp beam travels in the direction of the arrow 23 into the loom until the stop members 16 of the brackets 10, 10' contact the respective housing of the bearings 5, 5' in the loom. Even before the stopped position is reached, the components 25, 25a, 31, and 31a of the lateral restraining device 14 begin to cooperate with each other in that the conical tip 25a moves into the gap between the rollers 31, whereby the carriage 1 is displaced parallel to the axis 24 if necessary. The rollers 34 permit this type of movement. The travel in the direction of the arrow 23 continues until the bearing housings have been contacted by the stop member 16. Upon reaching of this position, optical or acoustic signals may be provided to alert an operator that the piston cylinder devices 21, 21' are to be activated for causing the rollers 19, 19' to contact the bearing housings 5,5' by tilting the tilting lever 18, 18' about its journal 18A, 18B until the rollers 19, 19' contact the respective bearing housing 5, 5'. In this manner the warp beam 2 is held in a position substantially in axial alignment with the central axes of the floating bearing housings 5, 5'. Any further adjustment for eliminating any level difference H is then performed as described above. This leveling now assures a precise alignment of the longitudinal axis 24 of the warp beam with the longitudinal central axis of the bearings 5, 5', whereby the axle stubs 4, 4' can now be inserted through the bearings into the sockets 11, 11' of the warp beam shaft 2a. Once these axle stubs have been inserted, the leveling means 15, 15' are opened into the position shown in FIG. 3 and the carrier arms 9, 9' are lowered by the power lifts not shown. The carriage 1 is now moved out of the loom in a direction opposite to the arrow 23, whereby at the same time, the rollers 31 disengage from the lateral restraining pin 25. When the carriage is entirely removed, the carriage can now be prepared for the next exchange.

Although the invention has been described with reference to specific example embodiments, it will be appreciated that it is intended to cover all modifications and equivalents within the scope of the appended claims.

What we claim is:

1. A lifting carriage for exchanging a warp beam having floating axle stubs in a loom having floating bearings through which said floating axle stubs extend into respective sockets in ends of a warp beam shaft, comprising a carriage frame, carrier transom means operatively mounted in said carriage frame, adjustable transom sections mounted to said carrier transom means and being adjustable in length to the length of said warp beam, each adjustable transom section comprising an insertion stop mechanism for limiting an insertion depth of said lifting carriage horizontally into said loom, warp beam carrier arms operatively mounted to said transom sections, warp beam gripper means secured to free ends of said carrier arms, said insertion stop mechanism extending in parallel to said carrier arms carrying said gripper means, means for vertically leveling and axially aligning said gripper means with said warp beam shaft, said leveling means cooperating with said insertion stop mechanism in an aligning operation, and means for laterally restraining said lifting carriage horizontally in a direction of a longitudinal axis of said warp beam.

2. The lifting carriage of claim 1, wherein said insertion stop mechanism and said vertical leveling means for said carrier arms cooperate with said floating bearings of said loom for receiving said floating axle stubs through said floating bearings.

3. The lifting carriage of claim 2, wherein said insertion stop mechanism comprises a rigid bracket (10) rigidly secured to the respective adjustable transom section, said rigid bracket carrying at its end facing a respective one of said floating bearings of said loom, a level adjustable stop member which is adjustable in its vertical level.

4. The lifting carriage of claim 2, wherein said leveling and aligning means comprise a tilting lever at each of said insertion stop mechanisms, journal means journalling said tilting lever to an axis at the respective insertion stop mechanism, said tilting lever having a free end reaching at least partly around the respective floating bearing of said loom, said free end carrying a leveling roller, and drive means for operating said tilting lever.

5. The lifting carriage of claim 4, wherein said drive means for operating said tilting lever is a piston cylinder device.

6. The lifting carriage of claim 4, wherein said adjustable transom sections are rotatable through an angular range corresponding to a lifting or lowering of a warp beam axle for a proper alignment with said floating bearings in said loom.

7. The lifting carriage of claim 4, wherein said drive means are mounted to the respective insertion stop mechanism and connected to the respective tilting lever for operating said tilting lever.

8. The lifting carriage of claim 6, wherein said carrier transom means is journalled in a cross beam of said lifting carriage.

9. The lifting carriage of claim 6, wherein said leveling rollers of said tilting lever reach in the insertion direction of the lifting carriage to contact said floating bearing of said loom.

10. The lifting carriage of claim 9, wherein said leveling rollers of said tilting lever reach in said insertion direction beyond a geometric longitudinal axis of said floating bearings.

11. The lifting carriage of claim 1, wherein said lateral restraining means of said loom comprise a position stop element (25) arranged in the area of one of said floating bearings.

12. The lifting carriage of claim 1, wherein said lateral restraining means comprise at least two laterally arranged stop rollers (31) arranged in the area of said insertion stop mechanism, said lateral stop rollers having axes extending in parallel with each other.

13. The lifting carriage of claim 1, wherein said carrier transom means comprise a hollow beam (6) and wherein said adjustable transom sections are received in each end of said hollow beam with an axial sliding fit for adjusting an effective length to said length of said warp beam, and means for securing each transom section in an adjusted position to said hollow beam.

14. The lifting carriage of claim 1, wherein said carrier arms comprise bushings slidably secured to the respective adjustable transom section, whereby each arm is positionable relative to its transom section, and means for securing said bushing in an adjusted position on its transom section.

* * * * *